US010022837B2

(12) United States Patent
Chen et al.

(10) Patent No.: US 10,022,837 B2
(45) Date of Patent: Jul. 17, 2018

(54) INNER RETAINING RING AND OUTER RETAINING RING FOR CARRIER HEAD

(71) Applicant: Applied Materials, Inc., Santa Clara, CA (US)

(72) Inventors: Hung Chih Chen, Sunnyvale, CA (US); Yin Yuan, Santa Clara, CA (US); Samuel Chu-Chiang Hsu, Palo Alto, CA (US); Huanbo Zhang, San Jose, CA (US); Gautam Shashank Dandavate, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 14/958,814

(22) Filed: Dec. 3, 2015

(65) Prior Publication Data

US 2016/0082571 A1 Mar. 24, 2016

Related U.S. Application Data

(63) Continuation of application No. 13/204,541, filed on Aug. 5, 2011, now abandoned.
(Continued)

(51) Int. Cl.
*B24B 37/32* (2012.01)
*B24B 41/06* (2012.01)

(52) U.S. Cl.
CPC ..... *B24B 41/06* (2013.01); *B24B 37/32* (2013.01); *B24B 41/067* (2013.01)

(58) Field of Classification Search
CPC ..... B24B 41/06; B24B 37/32; B24B 41/067; B24B 37/27; B24B 37/28; B24B 37/30
See application file for complete search history.

(56) References Cited

U.S. PATENT DOCUMENTS 5,643,061 A * 7/1997 Jackson ..... B24B 37/30 451/288
5,795,215 A 8/1998 Guthrie et al.
(Continued)

FOREIGN PATENT DOCUMENTS

CN 1430545 7/2003
CN 2760754 2/2006
(Continued)

OTHER PUBLICATIONS

European Examination Report in European Application No. 11815393.1, dated Jul. 7, 2016, 9 pages.
(Continued)

*Primary Examiner* — Christopher M Koehler
*Assistant Examiner* — Joel Crandall
(74) *Attorney, Agent, or Firm* — Fish & Richardson P.C.

(57) ABSTRACT

A carrier head for a chemical mechanical polisher includes a base, a substrate mounting surface, an annular inner ring and an outer ring. The inner ring has a lower surface configured to contact an upper surface of a substrate positioned on the substrate mounting surface, an outer surface, and an inwardly facing surface extending downwardly from the lower surface and is configured to circumferentially surround the edge of the substrate, the inner ring vertically movable relative to the substrate mounting surface. The outer ring has an inner surface circumferentially surrounding the inner ring, an outer surface, and a lower surface to contact the polishing pad, and the outer ring is vertically movable relative to and independently of the substrate mounting surface and the inner ring.

7 Claims, 6 Drawing Sheets

Related U.S. Application Data

(60) Provisional application No. 61/371,644, filed on Aug. 6, 2010, provisional application No. 61/479,271, filed on Apr. 26, 2011.

(56) References Cited

U.S. PATENT DOCUMENTS

| | | | | |
|---|---|---|---|---|
| 5,921,853 | A | 7/1999 | Nishio | |
| 6,019,670 | A * | 2/2000 | Cheng | B24B 37/32 451/286 |
| 6,110,025 | A | 8/2000 | Williams et al. | |
| 6,143,127 | A * | 11/2000 | Perlov | B24B 37/32 156/345.14 |
| 6,196,905 | B1 | 3/2001 | Inaba | |
| 6,334,810 | B1 | 1/2002 | Song et al. | |
| 6,375,549 | B1 | 4/2002 | Glashauser et al. | |
| 6,436,228 | B1 | 8/2002 | Zuniga et al. | |
| 6,517,422 | B2 | 2/2003 | Sakamoto et al. | |
| 6,663,468 | B2 | 12/2003 | Kawamura et al. | |
| 6,872,130 | B1 | 3/2005 | Zuniga | |
| 7,044,838 | B2 * | 5/2006 | Maloney | B24B 37/30 451/288 |
| 7,198,548 | B1 | 4/2007 | Chen | |
| 7,654,888 | B2 | 2/2010 | Zuniga et al. | |
| 7,901,273 | B2 | 3/2011 | Zuniga et al. | |
| 2002/0004361 | A1 | 1/2002 | Izumi et al. | |
| 2004/0152403 | A1 * | 8/2004 | Marohl | B24B 37/32 451/442 |
| 2007/0034335 | A1 | 2/2007 | Lee | |
| 2008/0119120 | A1 | 5/2008 | Zuniga et al. | |
| 2012/0034848 | A1 | 2/2012 | Chen et al. | |

FOREIGN PATENT DOCUMENTS

| | | |
|---|---|---|
| CN | 101396805 | 4/2009 |
| JP | 2000-311875 | 11/2000 |
| JP | 2002-018709 | 1/2002 |
| JP | 2008-302464 | 12/2008 |
| JP | 2008302464 | 12/2008 |
| JP | 2008307674 | 12/2008 |
| TW | 200709895 | 6/2006 |
| TW | 201000257 | 1/2010 |
| WO | WO 99/51397 | 10/1999 |

OTHER PUBLICATIONS

Japanese Office Action in Japanese Application No. 2013-523375, dated Jul. 26, 2016, 6 pages (English Translation).

Korean Search Report & Written Opinion for Application No. PCT/US2011/046828, dated Mar. 23, 2012, 12 pages.

Office Action in Chinese Application No. 201310170453.4, dated Dec. 25, 2014, 10 pages.

Ramos Herrero, Supplemental European Search Report for EP Application No. 11815393.1, dated Apr. 23, 2015, European Patent Office (3 pages).

Taiwan Office Action in Taiwan Application No. 102108272, dated Aug. 12, 2015, 16 pages (English Summary).

Chinese Office Action in Chinese Application No. 20118044017.1, dated Feb. 17, 2015, 15 pages (English Summary).

Korean Office Action in Korean Application No. 10-2013-7006070, dated Feb. 28, 2017, 6 pages (English Summary).

* cited by examiner

INNER RETAINING RING AND OUTER RETAINING RING FOR CARRIER HEAD

CROSS-REFERENCE TO RELATED APPLICATIONS

This application is a continuation of U.S. application Ser. No. 13/204,541, filed Aug. 5, 2011, which claims priority to U.S. Provisional Application Ser. No. 61/371,644, filed Aug. 6, 2010, and claims priority to U.S. Provisional Application Ser. No. 61/479,271, filed Apr. 26, 2011, each of which is incorporated by reference in its entirety.

TECHNICAL FIELD

This invention relates to a carrier head for use in chemical mechanical polishing.

BACKGROUND

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. For other applications, such as oxide polishing, the filler layer is planarized until a predetermined thickness is left over the non planar surface. In addition, planarization is needed to planarize the substrate surface for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

The carrier head provides a controllable load on the substrate to push it against the polishing pad. The carrier head has an inner ring which holds the substrate in place during polishing. The carrier head can also have an outer ring which surrounds the inner ring.

SUMMARY

The "edge exclusion region" is an annular region at the edge of the substrate where the polishing rate may deviate significantly from the polishing rate near the center of the substrate, rendering this region unsuitable or providing lower yield for devices. For example, for some carrier heads designed for polishing of a 300 mm wafer, the edge exclusion region can be about 15 mm wide.

A variety of techniques can be used to compensate for edge exclusion. For carrier heads that have both an inner ring and an outer ring, by making the inner ring relatively narrow, the outer ring can be moved sufficiently close to the edge of the substrate that both the inner ring and the outer ring may be used to control pressure near the edge of the substrate. For a carrier head with a retaining ring with an adjustable diameter, the diameter can be selected to provide a lateral spacing between the retaining ring and the substrate that improves polishing uniformity in the exclusion region. Also, some ring geometries can shift the pad contact away from the substrate edge.

In one aspect, a carrier head for a chemical mechanical polisher includes base, a substrate mounting surface, an annular inner ring, and an annular outer ring. The inner ring has an inner surface configured to circumferentially surround the edge of a substrate positioned on the substrate mounting surface, an outer surface, and a lower surface to contact a polishing pad. The inner ring is vertically movable relative to the substrate mounting surface. The outer ring has an inner surface circumferentially surrounding the inner ring, an outer surface, and a lower surface to contact the polishing pad. The outer ring is vertically movable relative to and independently of the substrate mounting surface and the inner ring. The lower surface of the inner ring has a first width, and the lower surface of the outer ring has a second width greater than the first width.

Implementations of the invention may include one or more of the following features. The substrate backing member comprises a flexible membrane. A first pressurizable chamber may apply a first pressure to the flexible membrane, a second pressurizable chamber may apply a second pressure to the inner ring, and a third pressurizable chamber may apply a third pressure to the outer ring. The first pressure, second pressure and third pressure are independently adjustable. The lower surface of the outer ring may be sufficiently close to the substrate mounting surface that pressure of the lower surface of the outer ring on a polishing pad affects a pressure on an edge of the substrate. The first width may be between about 0.04 and 0.20 inches. The second width may be up to 1 inch. The second width may be about five to fifteen times larger than the second width. The outer surface of the inner ring may include a sloped portion and the inner surface of the outer may ring include a sloped portion having the same angle of inclination as the sloped portion of the inner surface of the inner ring. The sloped portion of the outer surface of the inner ring may extend over the sloped portion of the inner surface of the inner ring. The bottom surface of the outer ring may be formed of a more rigid material than the bottom surface of the inner ring. A lower portion of the outer surface of the inner ring adjacent the lower surface of the inner ring may have smaller outer radial diameter than an upper portion of the outer surface of the inner ring adjacent the upper surface of the inner ring.

In another aspect, a carrier head for a chemical mechanical polisher includes a base, a substrate mounting surface, an annular inner ring, and an annular outer ring. The inner ring has an inner surface configured to circumferentially surround the edge of a substrate positioned on the substrate mounting surface, an outer surface, and a lower surface to contact a polishing pad. The inner ring is vertically movable relative to the substrate mounting surface. The outer ring has an inner surface circumferentially surrounding the inner ring, an outer surface, and a lower surface to contact the polishing pad. The outer ring is vertically movable relative to and independently of the substrate mounting surface and the inner ring. The lower surface of the outer ring is sufficiently close to the substrate mounting surface that pressure of the lower surface of the outer ring on a polishing pad affects a pressure on an edge of the substrate.

Implementations of the invention may include one or more of the following features. The first width may be between about 0.04 and 0.20 inches.

In another aspect, a carrier head for a chemical mechanical polisher includes a base, a substrate mounting surface, an annular inner ring and an annular outer ring. The inner ring has an inner surface configured to circumferentially surround the edge of a substrate positioned on the substrate mounting surface, an outer surface with a first sloped portion, and a lower surface to contact a polishing pad. The inner ring is vertically movable relative to the substrate mounting surface. The outer ring has an inner surface circumferentially surrounding the inner ring, an outer surface with a second sloped portion having the same angle of inclination as the first sloped portion, and a lower surface to contact a polishing pad. The outer ring is vertically movable relative to and independently of the substrate mounting surface and the inner ring.

Implementations of the invention may include one or more of the following features. The first sloped portion of the outer surface of the inner ring may extend over the second sloped portion of the inner surface of the inner ring.

In another aspect, a carrier head for a chemical mechanical polisher includes a base, a substrate mounting surface, an annular inner ring and an outer ring. The inner ring has a lower surface configured to contact an upper surface of a substrate positioned on the substrate mounting surface, an outer surface, and an inwardly facing surface extending downwardly from the lower surface and is configured to circumferentially surround the edge of the substrate, the inner ring vertically movable relative to the substrate mounting surface. The outer ring has an inner surface circumferentially surrounding the inner ring, an outer surface, and a lower surface to contact the polishing pad, and the outer ring is vertically movable relative to and independently of the substrate mounting surface and the inner ring.

Implementations can include one or more of the following features. The substrate mounting surface can be a flexible membrane. A bottom surface of the inner ring between the inwardly facing surface and an outer diameter of the inner ring may have a first width, and the outer ring have a second width greater than the first width. A height of the projection may be such that a bottom surface of the projection does not contact the polishing pad during polishing. The lower surface of the outer ring may be sufficiently close to the substrate mounting surface that pressure of the lower surface of the outer ring on a polishing pad affects a pressure on an edge of the substrate. A width of the bottom surface of the inner ring between the inwardly facing surface and an outer diameter of the inner ring may be between about 0.04 and 0.20 inches.

In another aspect, a carrier head for a chemical mechanical polisher includes a base, a substrate mounting surface, an annular inner ring, a middle ring, and an outer ring. The annular inner ring has an inner surface configured to circumferentially surround the edge of a substrate positioned on the substrate mounting surface, an outer surface, and a lower surface to contact a polishing pad, and the inner ring is vertically movable relative to the substrate mounting surface. The middle ring has an inner surface circumferentially surrounding the inner ring, an outer surface, and a lower surface to contact the polishing pad, and the outer ring is vertically movable relative to and independently of the substrate mounting surface and the inner ring. The outer ring has an inner surface circumferentially surrounding the middle ring, an outer surface, and a lower surface to contact the polishing pad, the outer ring vertically movable relative to and independently of the substrate mounting surface, the inner ring and the middle ring.

Implementations can include one or more of the following features. The substrate mounting surface may be a flexible membrane. The inner ring may have a first width and the middle ring may have a second width greater than the first width. The outer ring may have a third width greater than the second width. The first width may be between about 0.04 and 0.20 inches. The lower surface of the middle ring may be sufficiently close to the substrate mounting surface that pressure of the lower surface of the outer ring on a polishing pad affects a pressure on an edge of the substrate. The lower surface of the outer ring is sufficiently close to the substrate mounting surface that pressure of the lower surface of the outer ring on a polishing pad affects a pressure on an edge of the substrate.

In another aspect, a carrier head for a chemical mechanical polisher includes a base, a substrate mounting surface, and an annular retaining ring having an inner surface configured to circumferentially surround the edge of a substrate positioned on the substrate mounting surface, an outer surface, and a bottom having a lower surface adjacent the inner surface and a projection a bottom positioned radially outward of the lower surface with a bottom surface to contact a polishing pad. A height of the projection is such that the lower surface adjacent the inner surface does not contact the polishing pad, and the inner ring is vertically movable relative to the substrate mounting surface.

Implementations can include one or more of the following features. The substrate mounting surface may be a flexible membrane. A width of the lower surface may be sufficiently small that that changes in pressure of the retaining ring on a polishing pad result in changes in polishing rate on an edge portion of the substrate. The lower surface of the inner ring may have a first width and a bottom surface of the projection may have a second width greater than the first width. The first width may be between about 0.04 and 0.20 inches. A height of the projection may be such that the lower surface is below a bevel edge of the substrate.

In another aspect, a method of polishing includes selecting a first pressure for an inner ring of a carrier head and selecting a second pressure for an outer ring of the carrier head. The inner ring has an inner surface configured to circumferentially surround an edge of a substrate, the outer ring has an inner surface circumferentially surrounding the inner ring, the inner ring is vertically movable relative to the substrate mounting surface, the outer ring is vertically movable relative to and independently of the substrate mounting surface and the inner ring, a lower surface of the inner ring has a first width and the lower surface of the outer ring has a second width greater than the first width and the first width is sufficiently small that changes in pressure of the outer ring on a polishing pad result in changes in polishing rate on an edge portion of the substrate. The substrate is polished with first pressure for the inner ring and the second pressure for the outer ring, and the first pressure and the second pressure provide polishing uniformity on the edge portion of the substrate greater than polishing uniformity that would be achieved with at least some other pressures.

Implementations of the invention may include one or more of the following features. The first pressure and the second pressure may provide a best polishing uniformity out of combinations of pressures achievable by the carrier head for the inner ring and the outer ring. Selecting the first pressure and the second pressure may include polishing a plurality of test substrates at a plurality of different pressures for the inner ring and the outer ring, and measuring polishing uniformity of the plurality of test substrates.

In another aspect, a method of polishing includes selecting a first value for an inner diameter of a retaining ring of a carrier head to provide polishing uniformity in an edge portion of a substrate greater than polishing uniformity that would be achieved with a second value, adjusting the inner diameter of the retaining ring from the second value to the first value, wherein the first value provide a non-zero gap between the inner diameter and the substrate, and polishing the substrate while retaining the substrate in the carrier head with the retaining ring having the inner diameter at the first value.

Implementations of the invention may include one or more of the following features. Selecting the first value may include polishing a plurality of test substrates at a plurality of different values for the inner diameter of the retaining ring, and measuring polishing uniformity of the plurality of test substrates. The first value may be a value of the inner diameter of the retaining ring for a test substrate of the plurality of test substrates having a best polishing uniformity.

Implementations of the invention may include one or more of the following advantages. Both the inner ring and the outer ring may be used to control pressure near the edge of the substrate. This provides an additional controllable parameter for tuning of the pressure applied to the edge of the substrate. Consequently, polishing uniformity near the substrate edge may be improved, edge exclusion may be reduced, and yield may be increased.

The details of one or more implementations are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

Figure 1:
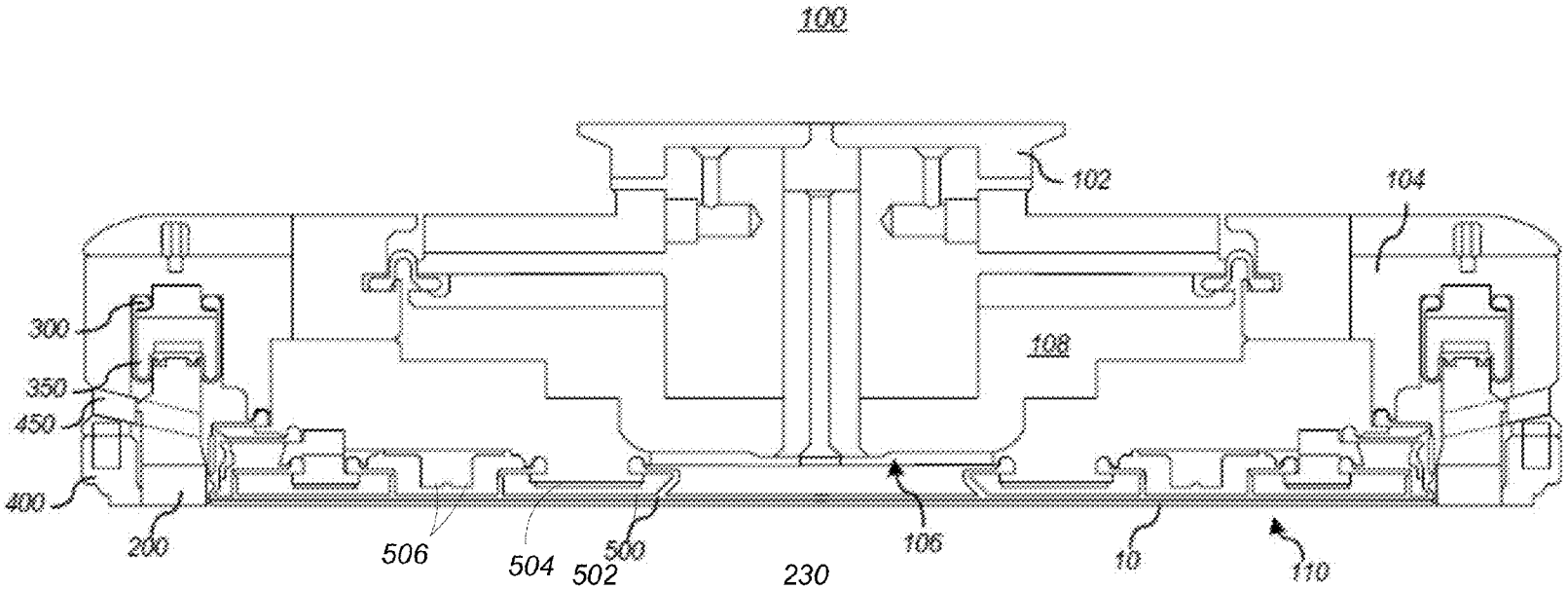
FIG. 1 shows a schematic cross-sectional view of a carrier head.

Referring to FIG. 1, a substrate 10 will be polished by a chemical mechanical polishing (CMP) apparatus that has a carrier head 100. A description of a CMP apparatus may be found in U.S. Pat. No. 5,738,574, the entire disclosure of which is incorporated herein by reference.

The carrier head 100 includes a housing 102, a base assembly 104, a gimbal mechanism 106 (which may be considered part of the base assembly 104), a loading chamber 108, an inner ring assembly including an inner ring 200 (which can also be called an inner ring) and a first flexible membrane 300 shaped to provide an annular chamber 350, an outer ring 400 (which can also be called an inner ring), and a substrate backing assembly 110 which includes a second flexible membrane 500 that defines a plurality of pressurizable chambers.

The housing 102 can generally be circular in shape and can be connected to a drive shaft to rotate therewith during polishing. There may be passages (not illustrated) extending through the housing 102 for pneumatic control of the carrier head 100. The base assembly 104 is a vertically movable assembly located beneath the housing 102. The gimbal mechanism 106 permits the base assembly 104 to gimbal relative to the housing 102 while preventing lateral motion of the base assembly 104 relative to the housing 102. The loading chamber 108 is located between the housing 102 and the base assembly 104 to apply a load, i.e., a downward pressure or weight, to the base assembly 104. The vertical position of the base assembly 104 relative to a polishing pad is also controlled by the loading chamber 108. The substrate backing assembly 110 includes a flexible membrane 500 with a lower surface 512 that can provide a mounting surface for a substrate 10.

Figure 2:
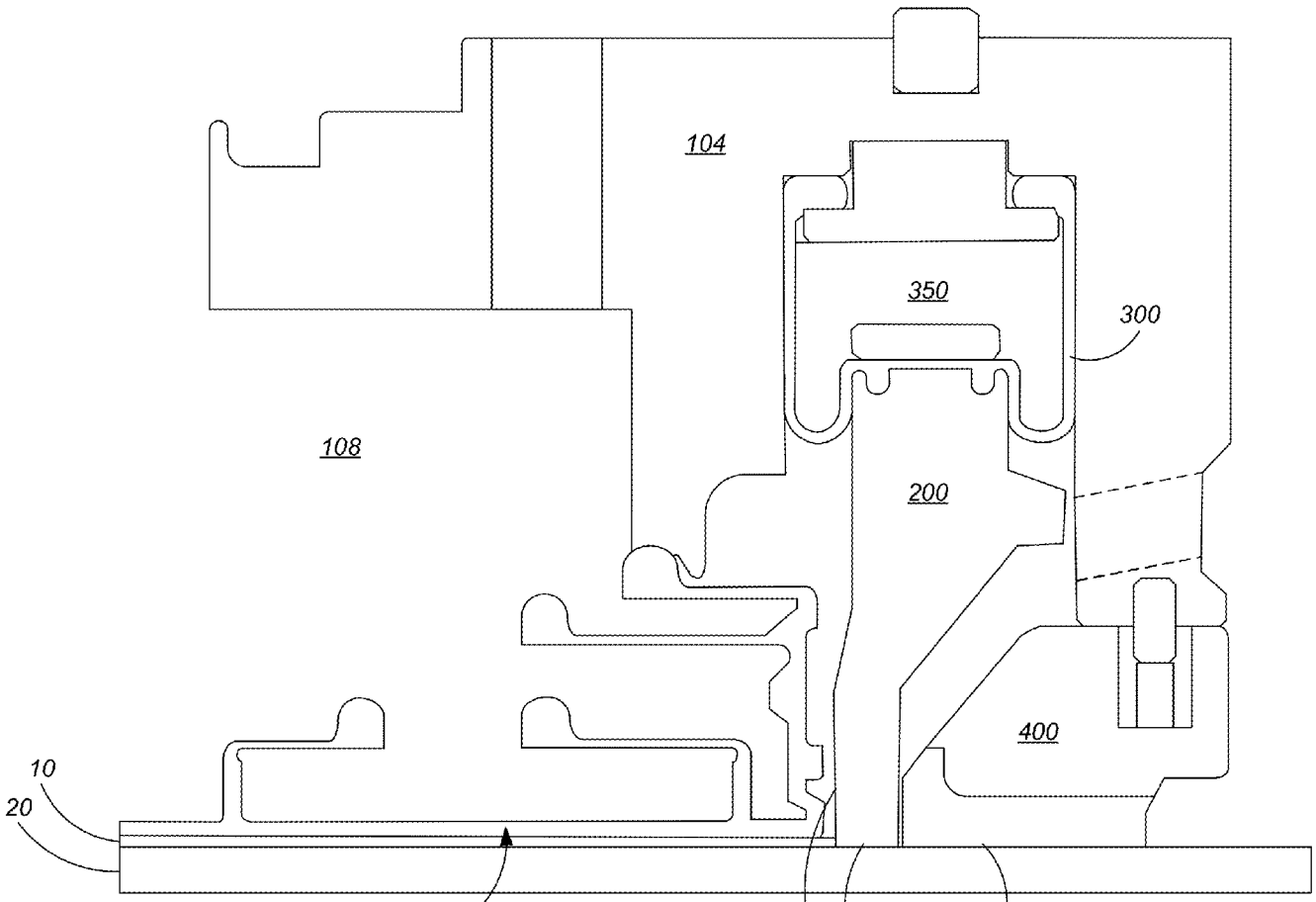
FIG. 2 shows an expanded side view, partially in perspective and partially cross-sectional, of a carrier head.

Referring to FIG. 2, a substrate 10 can be held by an inner ring assembly clamped to a base assembly 104. The inner ring assembly can be constructed from an inner ring 200 and a flexible membrane 300 shaped to provide an annular chamber 350. The inner ring 200 can be positioned beneath the flexible membrane 300 and configured to be secured to the flexible membrane 300.

Figure 3:
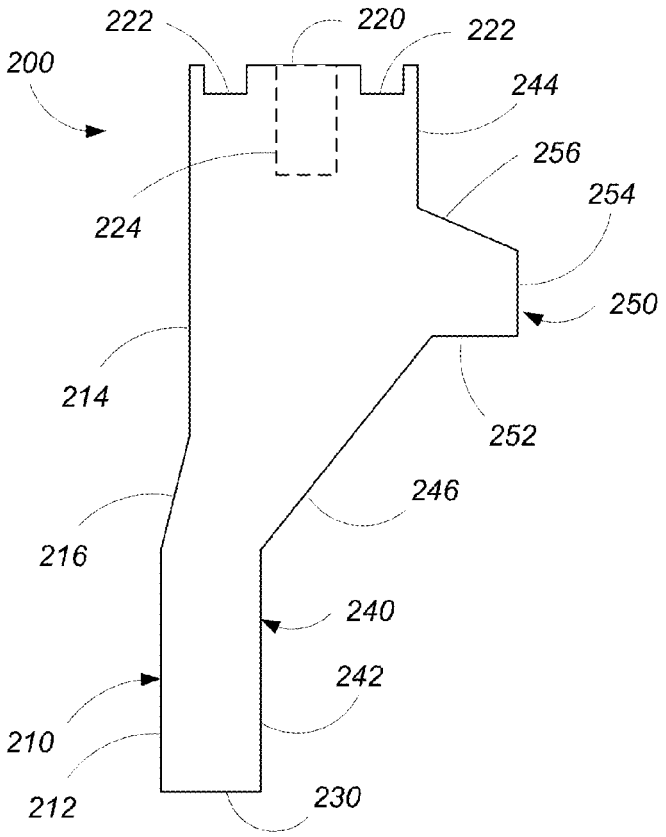
FIG. 3 is a cross-sectional side view of an inner ring.

Referring to FIGS. 2 and 3, the inner ring 200 is an annular body that has an inner surface 210, an annular upper surface 220, an annular lower surface 230, and an outer surface 240. A lower region 212 of the inner surface 210, adjacent to the lower surface 230, can be a vertical cylindrical surface, and can be configured to circumferentially surround the edge of a substrate 10 to retain the substrate during polishing. The lower region 212 of the inner surface 210 can have an inner diameter just larger than the substrate diameter, e.g., about 1-2 mm larger than the substrate diameter, so as to accommodate positioning tolerances of the substrate loading system. An upper region 214 of the inner surface 210 can be a vertical cylindrical surface, and can be slightly recessed relative to the lower region 212, e.g., the inner radial diameter of the upper region 214 of the inner surface 210 is greater than the inner radial diameter of the lower region 212 of the inner surface 210. A tapered region 216 can connect the lower region 212 to the upper region 214.

A lower region 242 of the outer surface 240, adjacent to the lower surface 230, can be a vertical cylindrical surface. The portion of the inner ring between the lower region 212 and the lower region 242 can provide a lower annular ring, e.g., with a width of 0.04 to 0.20 inches, e.g., 0.05 to 0.15 inches. An upper region 244 of the outer surface 240, adjacent to the upper surface 220, can be a vertical cylindrical surface, and the lower region 242 of the outer surface 240 can be recessed relative to the upper region 244, e.g., the outer radial diameter of the upper region 244 is greater than the outer radial diameter of the lower region 242 of the outer surface 240. The portion of the inner ring between the upper region 242 and the upper region 244 can provide an upper annular ring that is wider than the lower annular ring. The outer radial diameter of the lower ring (i.e., the lower region 242 of the outer surface 240) can be greater than the inner radial diameter of the upper ring (i.e., the upper region 214 of the inner surface 214).

The outer surface 240 of the inner ring 200 can project outwardly to form a lip 250 between the lower region 242 and the upper region 244. The lip 250 can have a horizontal lower surface 252, a vertical outer surface 254, and a sloping, non-horizontal upper surface 256. The lip 250 can provide a hard stop for the inner ring against the top inner edge of the outer ring 400 as the inner ring wears during substrate polishing. A recess above the lip 250 provides space for the side walls 324 of the flexible membrane 300 to roll when the chamber 350 is evacuated. A sloped area 246 of the outer surface 240 can connect the lower region 242 to the horizontal lower surface 252 of the lip 250.

The annular upper surface 220 that can have two annular concentric recesses 222 that extend entirely around the annular inner ring 200. These annular concentric recesses 222 can be sized to interlock with the flexible membrane 300.

The lower surface 230 of the inner ring 200 can be brought into contact with a polishing pad. At least a lower portion of the inner ring 200 that includes the lower surface 230 can be formed of a material which is chemically inert in a CMP process, such as a plastic, e.g., polyphenylene sulfide (PPS). The lower portion should also be durable and have a low wear rate. In addition, the lower portion should be sufficiently compressible so that contact of the substrate edge against the inner ring does not cause the substrate to chip or crack. On the other hand, the lower portion should not be so elastic that downward pressure on the inner ring causes the lower portion to extrude into the substrate receiving recess.

In some implementations, the inner ring 200 can be constructed from two rings, a lower annular portion and an upper annular portion. The upper portion of the inner ring 200 can be formed of a material that is more rigid than the lower portion. For example, the lower portion can be a plastic, e.g., PPS, and the upper portion can be a metal, e.g., stainless steel, molybdenum, or aluminum, or a ceramic, e.g., alumina.

The upper surface 230 can include cylindrical recesses or holes 234 with screw sheaths (not shown) to receive fasteners, such as bolts, screws, or other hardware, for securing the inner ring 200 to the flexible membrane 300 positioned above it. The holes 234 can be evenly spaced around the inner ring and can be positioned between the two annular concentric recesses 222.

In some implementations, the inner ring 200 has one or more slurry transport channels formed in the lower surface 230. The slurry transport channels extend from the inner diameter to the outer diameter of the lower ring portion to allow slurry to pass from the exterior to the interior of the inner ring during polishing. The slurry transport channels can be evenly spaced around the inner ring. Each slurry transport channel can be offset at an angle, e.g., 45°, relative to the radius passing through the channel. The channels can have a width of about 0.125 inches.

In some implementations, the inner ring 200 has one or more through holes that extend through the body of the inner ring from the inner surface 210 to the outer surface 240 for allowing fluid, e.g., air or water, to pass from the interior to the exterior, or from the exterior to the interior, of the inner ring during polishing. The through-holes can extend through the upper ring. The through holes can be evenly spaced around the inner ring.

In some implementations the upper portion 235 of the inner ring can be wider at its lower surface than its upper surface. For example, the inner surface 231 can have a tapered region 240 sloped inwardly (i.e., having decreasing diameter) from top to bottom below a vertical region 242. The inner surface of the lower portion 234 can be vertical. As the lower portion of the inner ring wears during substrate polishing, the narrower upper inner surface of the inner ring prevents wear on an adjacent flexible membrane that provides a substrate-mounting surface. In addition, in some implementations, the entire outer surface of the inner ring can be coated with a non-stick coating, e.g., parylene.

The inner ring 200 and a flexible membrane 300 together form the inner ring assembly. The flexible membrane 300 is configured to be clamped above to a base assembly 104 and secured below to an annular inner ring 200, providing an annular chamber 350 above the inner ring. When the annular chamber 350 is pressurized, the flexible membrane provides an independently controllable load on the inner ring. The load on the inner ring provides a load to a polishing pad. Independent loading on the inner ring can allow consistent loading on the pad as the ring wears. Positioning the flexible membrane between the inner ring and the carrier head can reduce or eliminate the impact of carrier distortion on the inner ring which occurs when the ring is directly secured to the carrier head. The elimination of this carrier distortion reduces the uneven wear on the inner ring, reduces process variability at the substrate edge, and enables lower polishing pressures to be used, increasing ring lifetime.

Figure 4:
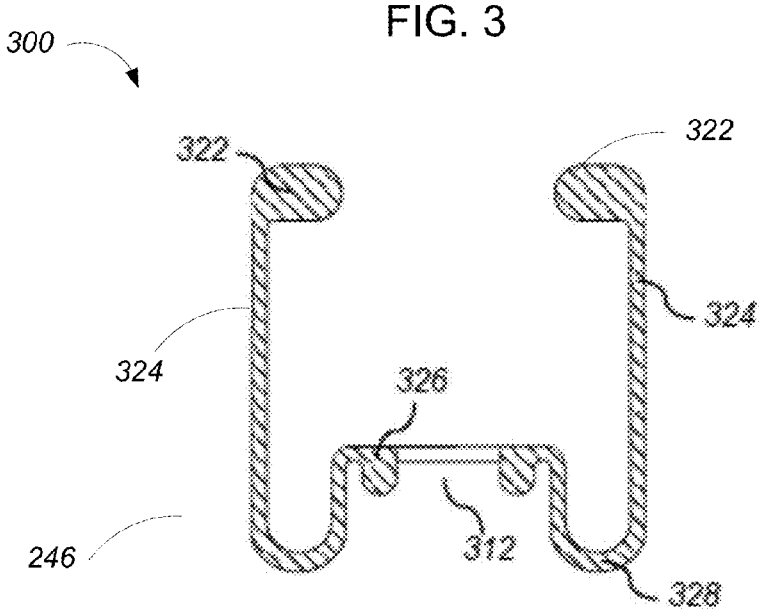
FIG. 4 is a cross-sectional side view of a membrane.

As shown in FIG. 4, the flexible membrane 300 has concentric inner and outer side walls 324. The flexible membrane 300 can have a pair of annular rims 322 extending horizontally and inwardly from the top edge of the side walls 324. The flexible membrane can be clamped to a base assembly 104 with a clamp ring positioned below the annular rims 322 of the flexible membrane. Additionally, the flexible membrane 300 has a lower surface. There can be two annular concentric projections 326 extending downwardly from the annular lower surface of the flexible membrane. These annular concentric projections 326 can be sized to fit into the annular concentric recesses 222 in the top surface 220 of the inner ring 200 positioned below the flexible membrane 300.

The flexible membrane 300 of the inner ring assembly can be formed of a material that is elastic, allowing the membrane to flex under pressure. The elastic material can include silicone and other exemplary materials.

The lower surface of the flexible membrane can include circular holes 312. The circular holes 312 can be positioned between the two annular concentric projections 326 and can be evenly spaced around the lower surface of the flexible membrane. The circular holes 312 can accommodate fasteners, such as bolts, screws, or other hardware, for securing the flexible membrane 300 to the inner ring 200. In some implementations, to secure the flexible membrane 300 to the inner ring 200, an adhesive, e.g., Loctite, is placed in the recesses 212, and one-way screws are inserted through the holes 312 in the flexible membrane 300 into the receiving recesses 212. Thus, the flexible membrane 300 can be effectively permanently joined to the inner ring 200.

In some implementations, the concentric inner and outer side walls 324 of the flexible membrane 300 can wrap around below to form a lower surface with curved portions 328. When the flexible membrane is secured to an inner ring 200, the curved portions 328 can extend below the upper surface of the inner ring. The curved portions 328 provide a rolling hinge that permits the bottom of the flexible membrane to move up and down in response to pressurization or evacuation of the chamber 350 without substantial bulging of the side walls 324. In some embodiments, the annular rims 322 can be thicker than the side walls 324 of the flexible membrane. The annular concentric projections 326 can also be thicker than the side walls 324.

While the inner ring 200 is configured to retain a substrate 10 and provide active edge process control, the outer ring 400 provides positioning or referencing of the carrier head to the surface of the polishing pad. In addition, the outer ring 400 contacts and provides lateral referencing of the inner ring 200. The outer ring 400 is configured to circumferentially surround an inner ring 200. Like the inner ring, the lower surface 433 of the outer ring 400 can be brought into contact with a polishing pad. The lower surface 433 of the outer ring 400 can be smooth and wearable surface; the lower surface 433 is not configured to abrade the polishing pad.

Figure 5:
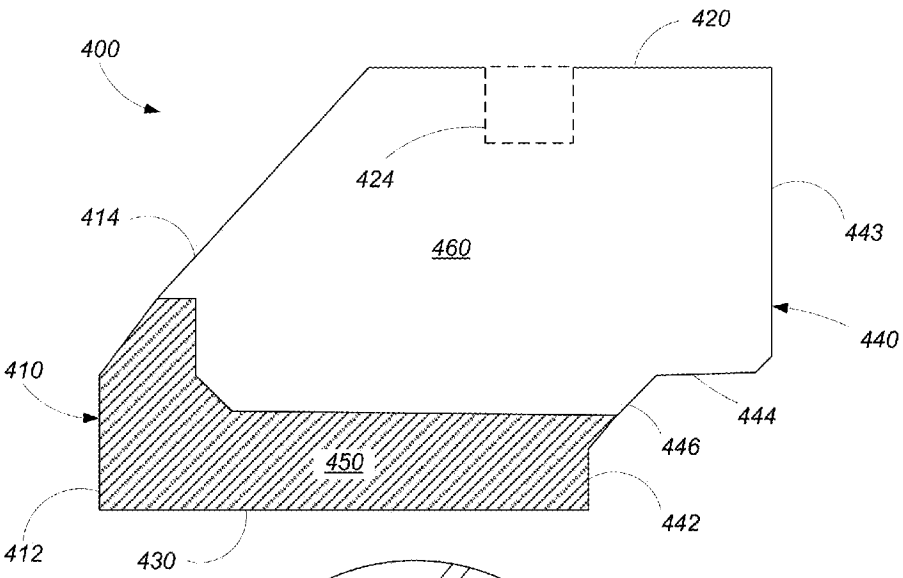
FIG. 5. is a cross-sectional side view of an outer ring.

As shown in FIG. 5, the outer ring 400 is an annular body that has an inner surface 410, an annular upper surface 420, an annular lower surface 430, and an outer surface 440. A lower region 412 of the inner surface 210, adjacent to the lower surface 430, can be a vertical cylindrical surface, and can be configured to circumferentially surround the lower portion 242 of the outer surface 240 of the inner ring 200. An upper region 414 of the inner surface 410 can be a sloped, and can have the same inclination as the sloped area 246 of the inner ring 200. The upper region 414 is sloped downwardly and radially inwardly, i.e., such that the inner radial diameter of the upper region 414 of the inner surface 210 is greater at the top of the upper region 414 than the bottom. The sloped area 246 of the inner ring 200 can extend vertically over the sloped upper region 414 of the outer ring 400.

A lower region 442 of the outer surface 440 of the outer ring 400, adjacent to the lower surface 430, can be a vertical cylindrical surface. An upper region 444 of the outer surface 440, adjacent to the upper surface 420, can be a vertical cylindrical surface, and the lower region 442 of the outer surface 440 can be recessed relative to the upper region 444, e.g., the outer radial diameter of the upper region 444 is greater than the outer radial diameter of the lower region 442 of the outer surface 440. The outer radial diameter of the lower region 442 of the outer surface 440 can be greater than the inner radial diameter of the upper region 414 of the inner surface 410. The outer surface 440 can also include a horizontal lower surface 444 and a sloping, non-horizontal lower surface 446. The horizontal lower surface 444 can provide a hard stop for the outer ring 400 against a substrate loading station, and the sloping surface 446 can provide for self-centering of the carrier head in the substrate loading station as the carrier head is lowered into the loading station.

The upper surface 420 of the outer ring 400 can be secured to the base 104, e.g., it is not vertically movable relative to the base 104. The upper surface 420 of the outer ring 400 can include cylindrical recesses or holes 424 with screw sheaths (not shown) to receive fasteners, such as bolts, screws, or other hardware, for securing the outer ring 400 to the base assembly 104. The holes 424 can be evenly spaced around the outer ring 400. In some implementations, the holes 424 do not extend over the horizontal lower surface 444.

A width of the lower surface 430 of the outer ring 400, i.e., between the lower region 412 of the inner surface 410 and the lower region 442 of the outer surface 440, can be greater than the width of the lower surface 230 of the inner ring 200, i.e., between the lower region 212 of the inner surface 410 and the lower region 242 of the outer surface 240. For example, the width can be 0.04 to 1.0 inches.

In some implementations, the outer ring 400 can be constructed from two rings, a lower annular portion 450 and an upper annular portion 460. The upper portion 460 of the outer ring 400 can be formed of a material that is more rigid than the lower portion 450. For example, the lower portion 450 can be a plastic, e.g., polyetheretherketone (PEEK), carbon filled PEEK, Teflon® filled PEEK, polyamidimid (PAI), or a composite material. The upper portion 460 can be a metal, e.g., stainless steel, molybdenum, or aluminum, or a ceramic, e.g., alumina.

The portion of the outer ring 400 that includes the lower surface 430 can be formed of a more rigid material than the portion of the inner ring 200 that includes the lower surface 230. This can result in the outer ring wearing at a lower rate than the inner ring. For example, the lower portion 450 of the outer ring 400 can be a plastic that is harder than the plastic of the inner ring 200.

In some implementations, the outer ring 400 has one or more through-holes that extend from the inner surface 410 to the outer surface 430 for allowing a liquid or air to pass from the interior to the exterior, or from the exterior to the interior, of the outer ring 400 during polishing. The through-holes can be evenly spaced around the outer ring 400. In some implementations, there are through-holes in the outer ring 400 but not in the inner ring 200. Thus, fluid, e.g., water from a cleaning system, that is sprayed through the through holes in the outer ring 400 will be flushed downward along the outer surface of the inner ring 200, thus clearing the space between the outer ring 400 and inner ring 200. In other implementations, there are through-holes in both the outer ring 400 and the inner ring 200, and the through holes are aligned so that fluid will pass through both the outer ring 400 and the inner ring 200. In such implementations, the through holes through the outer ring 400 can be the same width or wider than the through holes through the inner ring 200. In some implementations (see FIG. 2), through holes 450 are formed through a portion of the base 104 that surrounds the inner ring 200, rather than through the outer ring itself.

Figure 6:
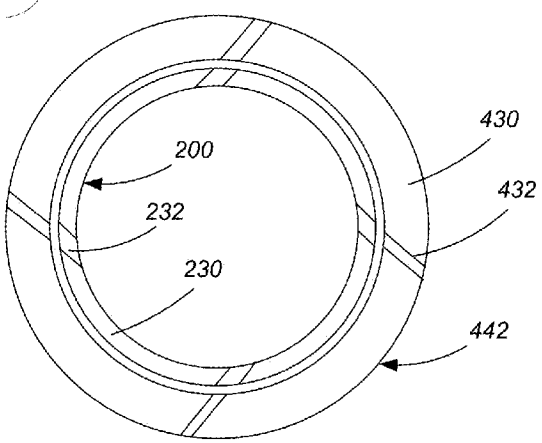
FIG. 6 is a bottom view of a carrier head.

Referring to FIG. 6, in some implementations, the outer ring 400 has one or more slurry transport channels 432 on the bottom surface 430 that extend from the inner surface 410 to the outer surface 440 to allow slurry to pass from the exterior to the interior of the outer ring during polishing. The channels can be evenly spaced around the outer ring. Each slurry transport channel can be offset at an angle, e.g., 45°, relative to the radius passing through the channel. The outer ring channels 432 can be aligned with the inner ring channels. In some embodiments, the outer ring channels 432 are wider than the inner ring channels 232, allowing slurry to pass more freely to the interior of the inner ring 200. For example, the outer ring channels 432 can have a width of about 0.25 inches.

Returning to FIG. 1, the flexible membrane 500 provides a surface 502 to mount the substrate 10. The flexible membrane 500 includes a plurality of flaps 504, which divide the volume between the flexible membrane 500 and the base assembly 104 into a plurality of individually pressurizable chambers 506. The pressurizable chambers 506 can be formed by clamping the flaps 504 to the base assembly 104 with a plurality of concentric clamp rings. The chambers can be configured to be successively narrower, from the innermost chamber to the outermost chamber.

Each chamber in the carrier head can be fluidly coupled by passages (not shown) through the base assembly 104 and housing 102 to an associated pressure source, such as a pump or pressure or vacuum line. There can be one passage for the annular chamber 350 of the flexible membrane 300, one passage for the loading chamber 108, and one passage for each of the pressurizable chambers 506 between the base assembly 104 and the flexible membrane 500. One or more passages from the base assembly 104 can be linked to passages in the housing 102 by flexible tubing that extends inside the loading chamber 108 or outside the carrier head 100. Pressurization of each chamber, and the force applied by the associated segment of the main portion 510 of the flexible membrane 500 on the substrate 10, can be independently controlled. This permits different pressures to be applied to different radial regions of the substrate during polishing, thereby compensating for non-uniform polishing rates.

The pressure on the inner ring 200 can be varied using chamber 350 relative to and independently of the pressure in the chambers 506 defined by the membrane 500, and the pressure on the outer ring 400 can be varied using the loading chamber 108 relative to and independently of the pressures on the inner ring 100 and in the chambers 506 defined by the membrane 500.

The outer ring 400 of the carrier head can apply a downward pressure to a polishing pad. As noted above, the lower surface 230 of the inner ring 200 is relatively narrow, permitting the lower surface 430 of the outer ring 400 to be positioned sufficiently close to the edge of the substrate that the outer ring 400 may be used to control pressure on the substrate in the area near the edge of the substrate. Since both the inner ring 200 and the outer ring 400 can be used to control pressure near the edge of the substrate, the pressure from the outer ring 400 on the polishing pad provides an additional controllable parameter for tuning of the pressure applied to the edge of the substrate. Consequently, polishing uniformity near the substrate edge may be improved, edge exclusion may be reduced, and yield may be increased. In particular, a set of pressures for the inner ring 200 and outer ring 400 can be identified by experimentation. For example, multiple test substrates can be polished using different combinations of pressures for the inner ring 200 and outer ring 400 for each test substrate, but otherwise using the same process parameters for polishing of device substrates. The uniformity of the test substrates in the area near the edge can be measured, e.g., using a stand-alone metrology unit, and the combination of pressures that provided the best polishing uniformity can be selected for later polishing of device substrates.

Figure 7:
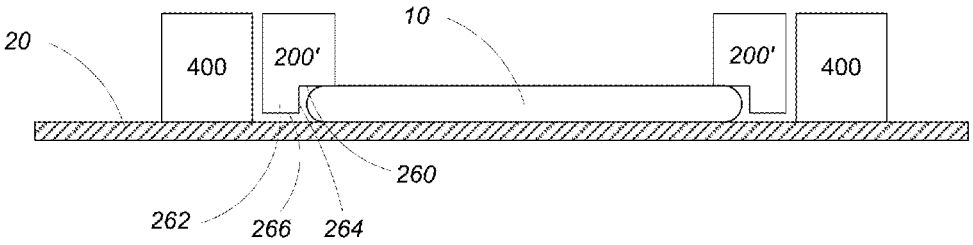
FIG. 7 shows a schematic cross-sectional side view of an inner ring, an outer ring and a substrate.

Referring to FIG. 7, in another implementation (which can otherwise be similar to the implementations discussed above), rather than be positioned to surround the substrate 10, the inner ring 200' can both rest on and circumscribe the substrate 10. In particular, bottom of the inner ring 200' can include a horizontal lower surface 260 adjacent an inner diameter of the inner ring 200', and a projection 262, positioned radially outward of the horizontal lower surface 260, that extends vertically past the horizontal surface 260. The horizontal lower surface 260 can contact the upper surface of the substrate 10 (i.e., the side of the substrate farther from the polishing pad). The inner diameter of the projection 260 provides an innerwardly facing surface 264 that retains the substrate. The height of the projection 262 can be less than the thickness of the substrate 10 such that the bottom surface 266 of the projection 260 does not contact the polishing pad 20 during polishing.

Figure 8:
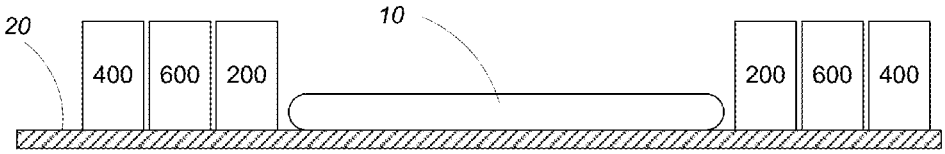
FIG. 8 shows a schematic cross-sectional side view of three rings and a substrate.

Referring to FIG. 8, in another implementation (which can otherwise be similar to the implementations discussed above), the carrier head can include three rings, including the inner ring 200, the outer ring 400, and a middle ring 600. Pressure on the middle ring 600 can be controlled in a manner similar to the retaining ring 200 with an additional chamber in the carrier head. Thus, pressure of each of the inner ring 200, outer ring 400, and middle ring 600 can be independently controllable. The additional degree of freedom provide by the middle ring 600 could permit superior polishing uniformity.

Figure 9A:
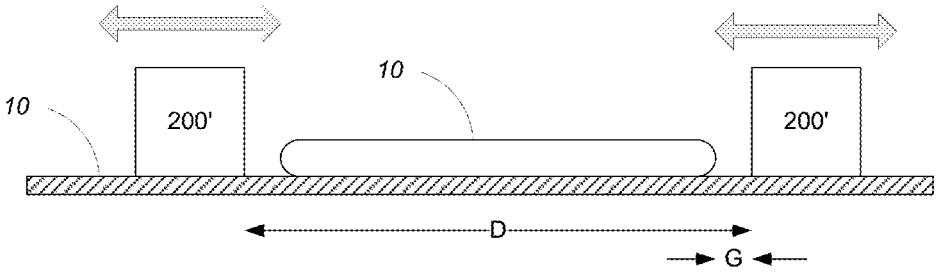
FIGS. 9A and 9B show schematic cross-sectional side views of a retaining ring and substrate.
Figure 9B:
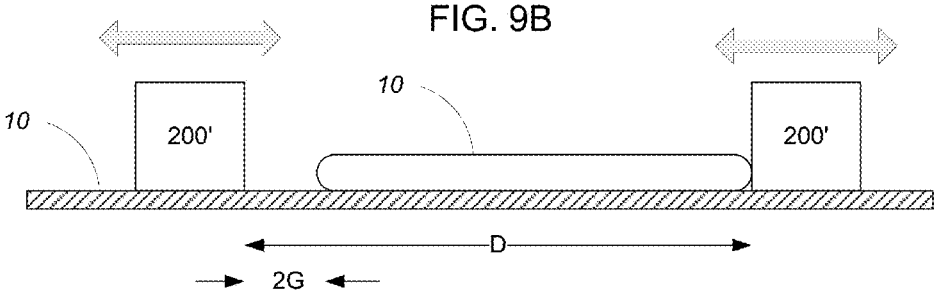

Referring to FIG. 9A, in another implementation, the carrier head can include a retaining ring 200' with an adjustable inner diameter D. Such a retaining ring is described in U.S. Pat. No. 6,436,228, which is incorporated by reference. The carrier head can include just a single retaining ring 200' (rather than both inner and outer retaining rings). The retaining ring 200' can be set with an inner diameter D sufficiently larger than the diameter of the substrate 10 to provide a gap having a non-zero average width G (averaged around the circumference of the substrate). Of course, during polishing, friction from the polishing pad will tend to drive a leading edge of the substrate 10 against the retaining ring 200', as shown in FIG. 9B, leaving a gap of width 2G on a trailing edge of the substrate 10. However, due to relative rotational motion between the substrate 10 and the retaining ring 200', the net result on the polishing rate at the substrate edge will be an average of the different compression effects on the polishing pad.

Selection of an appropriate inner diameter D of the retaining ring 200' can improve polishing uniformity near the substrate edge, reduce edge exclusion, and increase yield. In particular, the preferred diameter D for the retaining ring 200' for a particular set of polishing parameters can be identified by experimentation. For example, multiple test substrates can be polished using different diameters D for the retaining ring 200' for each test substrate, but otherwise using the same process parameters for polishing of device substrates. The uniformity of the test substrates in the area near the edge can be measured, e.g., using a stand-alone metrology unit, and the retaining ring diameter that provides the best polishing uniformity can be selected for later polishing of device substrates. As noted above, the inner diameter D can be sufficiently larger than the diameter of the substrate 10 to provide a gap having a non-zero average width G. Due to this non-zero width G of the gap, the substrate does not contact the retaining ring along a continuous circumferential zone of engagement extending around substantially the entire substrate perimeter.

Figure 10:
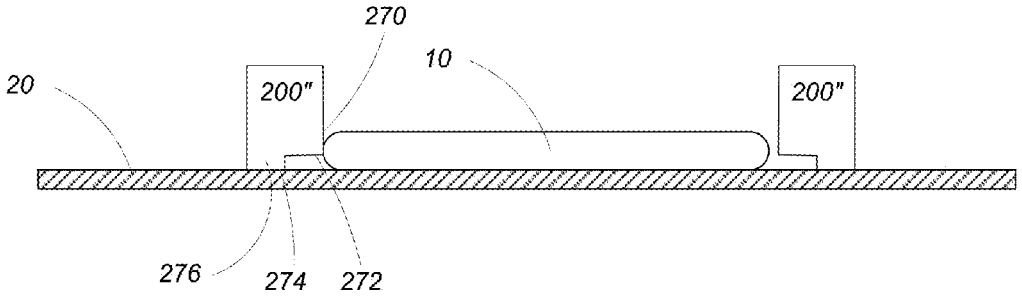
FIG. 10 shows a schematic cross-sectional side view of a retaining ring and a substrate.

Referring to FIG. 10, in another implementation, the carrier head can include a retaining ring 200" in which the lower surface includes a step. The step can be configured such that an inner diameter 270 of the retaining ring is adjacent and retains the substrate 10 (e.g., the substrate is driven into contact with the inner diameter 270 by friction from the polishing pad during polishing). A portion 272 of the bottom of the retaining ring immediately adjacent the inner diameter 270 that contacts the substrate provides a horizontal lower surface that does not contact the polishing pad 20, whereas a portion 274 of the bottom of the retaining ring that is radially outward of the portion 272 does contact the polishing pad 20 during polishing. In particular, the bottom of the retaining ring 200" can include a horizontal lower surface 272 adjacent an inner diameter 270 of the inner ring 200', and a projection 276, positioned radially outward of the horizontal lower surface 272, that extends vertically past the horizontal surface 272. The height of the projection 276 can be less than the thickness of the substrate 10, e.g., less than half of the thickness of the substrate 10, such that the horizontal lower surface 272 is below the bevel edge of the substrate 10. By selecting an appropriate width for the horizontal lower surface 272, contact of the retaining ring 200" with the polishing pad can be moved to a position that provides improved polishing uniformity. The retaining ring 200" could be formed from a low wear material, or the portion of the retaining ring 200" above the horizontal lower surface 272 could be formed from a material that wears more quickly than the projection 276. In addition, the portion of the retaining ring 200" above the horizontal lower surface 272 could be provided with features that increase the wear rate, e.g., vertical holes that decrease the surface area of the horizontal lower surface 272.

A number of embodiments of the invention have been described. Nevertheless, it will be understood that various modifications may be made without departing from the spirit and scope of the invention. For example, the base assembly 104 and the housing 102 could be combined as a single rigid part, and the entire carrier head 100 could be moved up and down by a vertically movable drive shaft, or a pressurizable chamber could be provided between the housing 102 and the outer ring so that inner ring and housing were both movable relative to the same rigid part. Accordingly, other implementations are within the scope of the following claims.

What is claimed is:

1. An outer ring of a carrier head of a polishing apparatus for lateral referencing of a retaining ring during polishing, comprising:

an annular body having an inner surface defining an inner diameter of the outer ring, an annular lower surface configured to be brought into contact with a polishing pad, an annular upper surface that includes a plurality of holes to receive fasteners, and an outer surface defining an outer diameter of the outer ring, wherein the inner surface includes a lower region, and an upper region, wherein the lower region of the inner surface is adjacent to the annular lower surface, the lower region of the inner surface is a vertical cylindrical surface configured to circumferentially surround and contact the retaining ring, the upper region of the inner surface connects and spans between the lower region and the annular upper surface and is sloped at a first angle of inclination with respect to the vertical cylindrical surface such that a first inner diameter of the upper region of the inner surface is greater at a top of the upper region of the inner surface than a second inner diameter at a bottom of the upper region of the inner surface, and wherein the outer surface includes a lower region, an upper region, a horizontal lower surface, and a sloped area, wherein the lower region of the outer surface is adjacent to the annular lower surface, the lower region of the outer surface is a vertical cylindrical surface, the upper region of the outer surface is a vertical cylindrical surface and has a first outer diameter that is greater than a second outer diameter of the lower region of the outer surface, the horizontal lower surface extends inwardly from the vertical cylindrical surface of the upper region of the outer surface, the sloped area connects and spans the lower region of the outer surface to the horizontal lower surface, and a height of the lower region of the inner surface is about equal to a height of the horizontal lower surface of the outer surface.

2. The outer ring of claim 1, wherein the annular body comprises an upper portion between the upper region of the inner surface and the upper region of the outer surface and a lower portion between the lower region of the inner surface and the lower region of the outer surface, wherein the upper portion is a different material than the lower portion.

3. The inner ring of claim 2, wherein the upper portion is formed of a material that is more rigid than the lower portion.

4. The inner ring of claim 2, wherein the lower portion is a plastic and the upper portion is a metal.

5. The inner ring of claim 2, wherein a boundary between the upper portion and the lower portion intersects the outer surface in the sloped area.

6. The outer ring of claim 1, wherein a first height of the lower region of the inner surface between the annular lower surface and the upper region of the inner surface is greater than a second height of the lower region of the outer surface between the annular lower surface and the sloped area of the outer surface.

7. The outer ring of claim 1, wherein the holes are positioned such that they do not extend over the horizontal lower surface.

* * * * *